United States Patent [19]

Adams

[11] 4,333,642

[45] Jun. 8, 1982

[54] TOY

[76] Inventor: Andrea V. Adams, Rte. #1, Box 378, Bentonville, Ark. 72712

[21] Appl. No.: 171,446

[22] Filed: Jul. 23, 1980

[51] Int. Cl.[3] ..... A63G 31/00

[52] U.S. Cl. ..... 272/1 D

[58] Field of Search ..... 272/1 D, 25, 21, 22, 272/1 B

[56] References Cited

U.S. PATENT DOCUMENTS

| | | | |
|---|---|---|---|
| 1,403,434 | 1/1922 | Maroukis | 272/1 B |
| 1,914,732 | 6/1933 | Breault | 272/1 D |
| 2,659,600 | 11/1953 | Becker | 272/1 D |
| 2,707,102 | 4/1955 | Wendt | 272/1 D |
| 2,738,974 | 3/1956 | Vincent | 272/1 D |
| 3,093,925 | 6/1963 | Greene | 272/1 D X |
| 3,224,762 | 12/1965 | Strader | 272/1 D |

*Primary Examiner*—George J. Marlo
*Attorney, Agent, or Firm*—Haverstock, Garrett & Roberts

[57] ABSTRACT

A toy horse supported on the user by a shoulder harness assembly and comprising a hollow body member having a central opening formed in the upper back portion thereof and a normally unobstructed space therebeneath, the central opening being of sufficient size to receive the body of a user when positioned therein, a second body opening located adjacent to one end portion of the body member, a support member attached to the body member and extending across the inside portion of the body member adjacent to the second opening, an elongated assembly having one end portion extending into the second body opening and pivotally mounted to the support member for movement relative to the body member in a substantially vertical plane between a predetermined at rest position and an elevated position angularly related thereto, a second assembly pivotally mounted to the opposite end portion of the elongated assembly for movement relative to the elongated assembly in substantially all directions thereon between a predetermined at rest position and a position angularly related thereto, a first yieldable member connected between the body member and the elongated assembly biasing the elongated assembly towards its predetermined at rest position, a second yieldable member connected between the assembly biasing the second assembly towards its predetermined at rest position, a strap member attachable to the second assembly for actuating and controlling the movements and positions of the elongated assembly and the second assembly, and a leg strap member centrally positioned below the central opening and extending lengthwise therebeneath having opposite end portions connected respectively to the body member adjacent opposite ends thereof, the leg strap member being positioned so as to lie between the legs of a user when positioned therein.

20 Claims, 12 Drawing Figures

TOY

This invention relates to a toy preferably in the form of an animal such as a horse intended for use mainly by children, and more particularly, to a toy construction adaptable to be supported on the shoulders of a user having an articulated head portion allowing movement in substantially all directions for simulating head turning and tossing, a movable neck portion for simulating rearing, drinking, and other such realistic neck movements, means for respectively returning the head and neck portions to their original at rest positions whenever displaced therefrom, manually operable means for actuating head and neck movement, and a leg strap member which stabilizes all motion. Although the present toy is adaptable to simulate a wide variety of animals or other characters, a toy fashioned to simulate the appearance of a horse will be described hereinafter for ease of discussion and explanation.

Different kinds of composite toy constructions and like toys fashioned after animal forms and characters are known and have been employed for use by children to simulate, when worn or carried in the prescribed manner, a child on horseback, riding a pony or other similar animals or characters. The prior art devices teach a wide variety of toy animal constructions adaptable to be worn about the waist and/or supported from the shoulders. Typical of such known constructions are those patterned somewhat after the conventional broom or stick-type horse construction which normally includes a horizontally disposed main frame member contoured so as to be adaptable for riding by holding and extending the main body of the horse or other animal between the legs of the rider. Other known constructions have included conventional shell-type constructions which are molded and shaped to simulate the torso of a horse or other similar animal characters. Typical of such known shell constructions are those which include two or more opposed flexible panels formed from corrugated cardboard or other thin moldable materials which are held together at a plurality of spaced apart locations by adhesive material strips or other similar connecting means and further include an opening therein whereby the shell construction fits about the body of a person and is supportable thereon by shoulder straps or other means adaptable to engage and cling to the body of a person interposed therebetween. Still other known embodiments provide body constructions which are inflatable and which can be utilized as boating or swimming toys. See for typical examples the constructions shown in Becker U.S. Pat. No. 2,659,600; Strader U.S. Pat. No. 3,224,762; and White U.S. Pat. No. 3,920,239. Although the known devices for the most part are characterized by the conventional hobby horse constructions previously described, still other known constructions have attempted to increase the realism of such toy constructions by providing means for imparting action to various parts of an animal's anatomy such as the legs, ears, tail and other components thereof. See for typical examples the constructions shown in Vincent U.S. Pat. No. 2,738,974; and Wendt U.S. Pat. No. 2,707,102. Nevertheless, the known prior art constructions utilize relatively few, if any, movable components and none of the prior art devices realistically portrays movements such as animal movements that simulate head turning, tossing, rearing, eating and drinking, and other head and neck movements of animals such as a horse.

Although the various known constructions as disclosed in the above-identified patents have attempted to improve the flexibility, durability, comfort, and realism of toy animal constructions, all such devices suffer from certain disadvantages and shortcomings. For example, such constructions have included complicated and cumbersome mechanisms for actuating movements of various component parts and extremities of the animal form while other constructions utilize no movable components whatsoever. Furthermore, no known construction includes a movable neck portion controlled by the user, an articulated head allowing movement in substantially all possible directions that simulate realism including means to return the head and neck portions to their neutral or at rest positions, and no known device has a stabilizing leg strap member which increases maneuverability and makes the toy easier to wear and to control. Many known constructions also require attachment means for holding and supporting the device in proper position on the user which means utilize stretchable plasticized and elasticized materials which conform and cling to the body of the user, all of which can cause friction burns, chaffing, and other discomforts to the person wearing the toy. In addition, such plasticized and elasticized materials are also able to go into body creases and cause further irritation and discomfort. Additionally, most of the prior art constructions are relatively large, bulky and cumbersome thereby restricting body movements and causing undue fatigue to the person wearing the toy construction, especially if such person is a small child. For these and other reasons, the known constructions have not been entirely satisfactory and have enjoyed limited usefulness.

The present construction overcomes these and other shortcomings and disadvantages of known prior art devices including the toy constructions disclosed in the named patents, and teaches the construction and operation of a relatively simple, lightweight, toy fashioned to simulate the appearance of a horse or other animal and which can be operated to impart realism to the composite animal form by providing movable head and neck portions controlled by the user to simulate realistic movements and the present device includes a leg strap member for stabilizing its position on the user and improving the maneuverability and controlability of the structure. When fashioned in the manner of a horse, the present device is able to be operated to realistically simulate the head and neck movements of a horse normally experienced by a rider and gives the child or other user a feeling and realistic impression of being on a real horse by allowing such user to effectively control and manipulate movements such as head turning, tossing, rearing, eating, drinking and other such movements. This increased flexibility and mobility of the present device substantially increases the overall interest in a toy of this type and adds life and action to the device not achieved in other known devices. In the imaginative eyes of a child or other user, this simulated movement imparts action, spirit and realism to the present device comparable to that of a real horse or other animal and helps to promote a close association between the child and the present toy construction substantially similar to that experienced between a rider and his real-life horse or other animal.

The present device consists primarily of a hollow, lightweight, reproduction of the torso portion of an animal such as a horse preferably scaled for use by children which includes a central opening cut in the upper back portion of the body member or shell, such as at the location where a saddle would normally be positioned on a horse, wherein a child or other user can wear and use the device by stepping through or into the central opening. This opening is preferably elongated from front to rear so that it will more easily permit freedom for running and manipulation of the body member and will likewise accommodate larger children. It should be noted that the body member or shell can be easily and conveniently made adaptable to simulate the appearance of a wide variety of animals or other characters including modifications in both body size and shape. Adjustable shoulder straps are attached to the body member near the front and rear portions of the central opening and are positioned to extend over the shoulders to hold and support the device at the proper waist position. The design of the shoulder harness assembly greatly facilitates the ease with which the user can get into and out of the present device and enhances both the comfort of the user and the amount of control and maneuverability over its movement.

The novelty of the present device resides mainly but not entirely in the movability of both the head and neck portions of the present toy construction and also in the provision of a stabilizing leg strap member. The movability of the head and neck portions is accomplished by means pivotally connecting the head and neck portions to each other and to the body member. It is of special importance to the present invention that the present device include means to return the head and neck portions to some neutral or at rest position after movement is accomplished thereby retaining correct posture whenever the subject components are at rest. A cord or other suitable strap means, representing, for example, the reins of a horse, are attached to the movable head portion in such a realistic manner that when a pulling force in any direction is applied to the strap means, the head and neck portions are drawn by such pulling action in corresponding directions about their respective pivot means depending upon the specific direction of pull on the strap means. This pulling action controls the range of movement of both the head and neck portions of the animal form. It should be noted that head movement is preferably accomplished by use of a ball and socket means wherein head motion is possible in substantially all of the directions that an animal can realistically move its head to simulate head turning and tossing whereas the range of motion of the neck is restricted to an up and down movement simulating rearing, eating or grazing, drinking, and whatever other movements an animal might realistically make in such direction. It is also anticipated that the present device may likewise include optional features such as movable ears and tail and/or an elastic tail base.

The stabilizing leg strap member extends in a front to back direction along and within the central body opening and is fastened at both ends thereof to the body member and is centrally positioned so that it will lie between the legs of a child or other user positioned in the opening. This strap member stabilizes the entire structure on the child and can be easily adapted to be adjustable so as to raise or lower the position of said member to accommodate users of varying stature. This stabilizing effect does not inhibit the child's walking or running ability but is important to the user's sense of control because it increases the manageability and maneuverability of the present device and serves to regulate all action or movement imparted to the device by the user. Furthermore, because of the movability of both the head and neck portions, the leg strap member counteracts the upholding effect of the shoulder harness and functions to maintain the present device at proper waist position so that when the cord or other strap means are pulled in imparting movement to the head and neck portions, the body member remains in relatively stable position on the user. In addition, the leg strap member also serves as a dampening mechanism to keep the body member from swaying back and forth like a pendulum, and likewise dampens all vertical motion created by the running or jogging action transmitted by the user and keeps the present device from flopping about erratically.

Although it is anticipated that the present device will be fashioned after an animal such as a horse, it can likewise be easily and conveniently fashioned after other animal characters such as the donkey, zebra, camel, swan, turtle, dinosaur, elephant and so forth. Regardless of the animal character selected, the movability of the head and neck portions and the provision of a stabilizing leg strap member are of special importance to the present invention. In addition, it is also anticipated that other possible applications of some portions of the present device may likewise include cartoon type characters, airplanes, spaceships, and other similar forms although such devices may lack the same head and neck movements which typify most animals.

It is therefore a principal object of the present invention to provide a toy construction having means associated therewith for imparting movement to the head and neck portions thereof that simulate the realistic movements of an animal when the device is being worn and manipulated by the user.

Another object is to provide a toy construction having a stabilizing leg strap member which stabilizes the device on the user and adds to the maneuverability and regulation thereof.

Another object is to provide a toy construction utilizing a shoulder harness assembly which facilitates the ease with which the user can get into and out of a present device and substantially enhances the comfort, control, and maneuverability of the entire device.

Another object is to provide a relatively inexpensive toy construction which is lightweight, durable, and may be supported by the shoulders of a child or other user without causing undue fatigue and discomfort.

Another object is to provide a toy which is easy to put on and comfortable to wear.

Another object is to provide a relatively simple toy construction which can be economically produced.

Another object is to provide a toy construction which can be easily and conveniently fashioned after numerous animal forms and other characters and objects.

Another object is to provide a toy utilizing a torso shell construction adaptable to simulate the appearance of a wide variety of different horse breeds such as, for example, the Pinto, Appaloosa, Palomino, and the like.

Another object is to provide a toy for active children which is fun to use because of its many possible movements and does not substantially restrict the child's ability to run and/or otherwise maneuver the subject device.

These and other objects and advantages of the present invention will become apparent to those skilled in the art after considering the following detailed specification in conjunction with the accompanying drawings, wherein.

Figure 1:
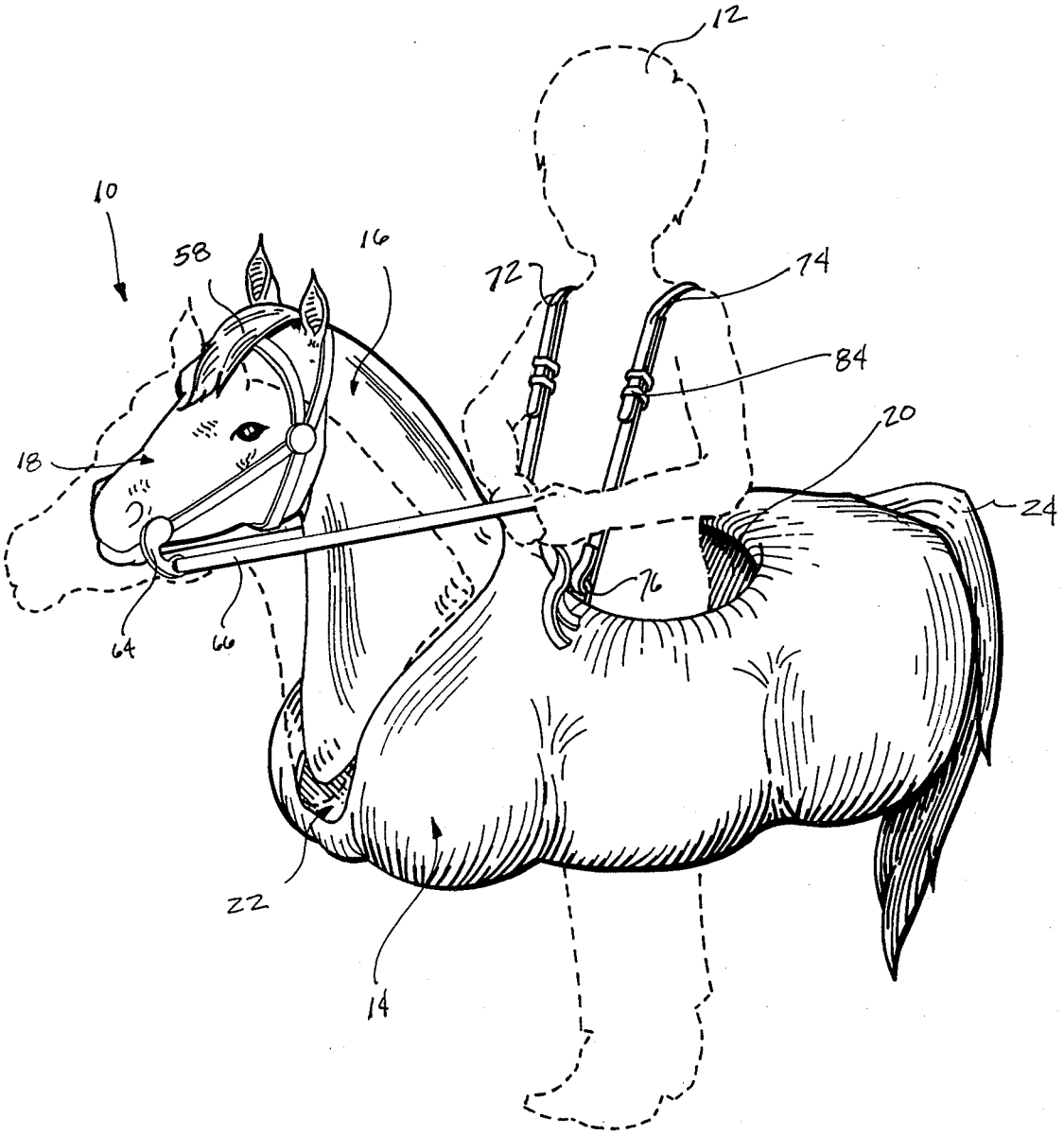
FIG. 1 is a perspective view of a toy horse constructed according to the teachings of the present invention and adaptable to be supported by the shoulders of a child or other user shown in dotted outline, said device also showing the neutral or at rest positions of the movable head and neck assemblies in dotted outline.
Figure 5:
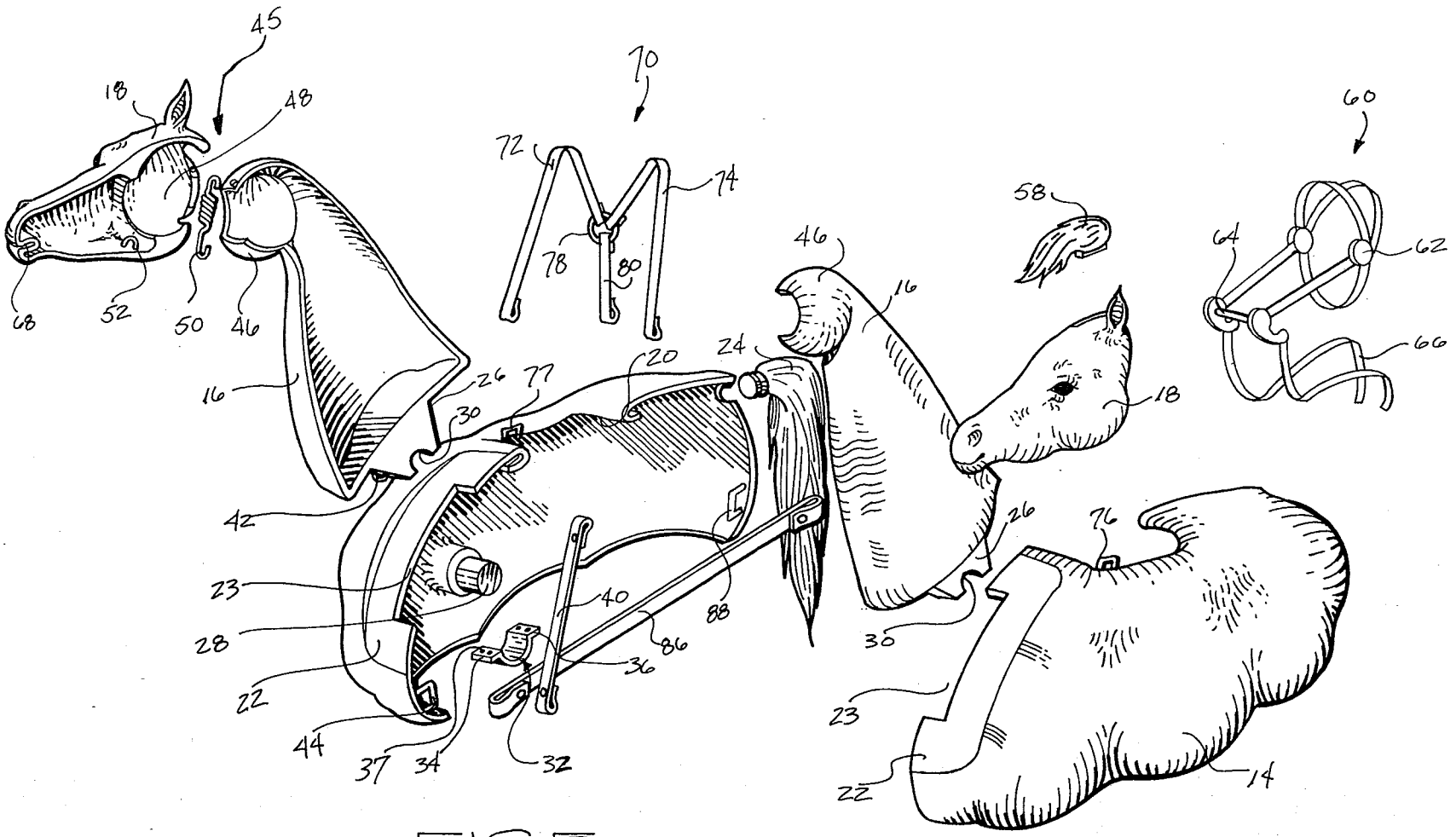
FIG. 5 is an exploded perspective view of the present toy construction showing the mechanism for achieving movement of the head and neck assemblies.

Referring to the drawings more particularly by reference numbers wherein the same reference numbers are used to identify corresponding parts in the several figures, number 10 in FIG. 1 identifies a toy horse device 10 constructed according to the teachings of the present invention, the device being shown in operative position on a child 12. The composite toy construction 10 includes a hollow lightweight, reproduction of the torso of a horse preferably scaled down to be worn by children, and it includes a torso portion 14, a neck assembly 16 movably attached to the torso 14, and a head assembly 18 cooperatively engageable with the neck assembly 16 and movable in many different directions thereon. The torso 14 preferably is of a hollow one-piece shell construction having a central opening 20 formed in the upper back portion thereof at a location where a riding saddle would normally be located, and having a relatively unobstructed space formed therebeneath as best shown in FIG. 5. This means that when the child is positioned in the opening 20 its legs will be able to move in the usual manner without restriction. The opening 20 is preferably elongated somewhat from front to rear so that it will more easily permit and readily facilitate freedom for running and manipulation of the device 10 and, at the same time, accommodate children and other users of varying age and stature.

Figure 6:
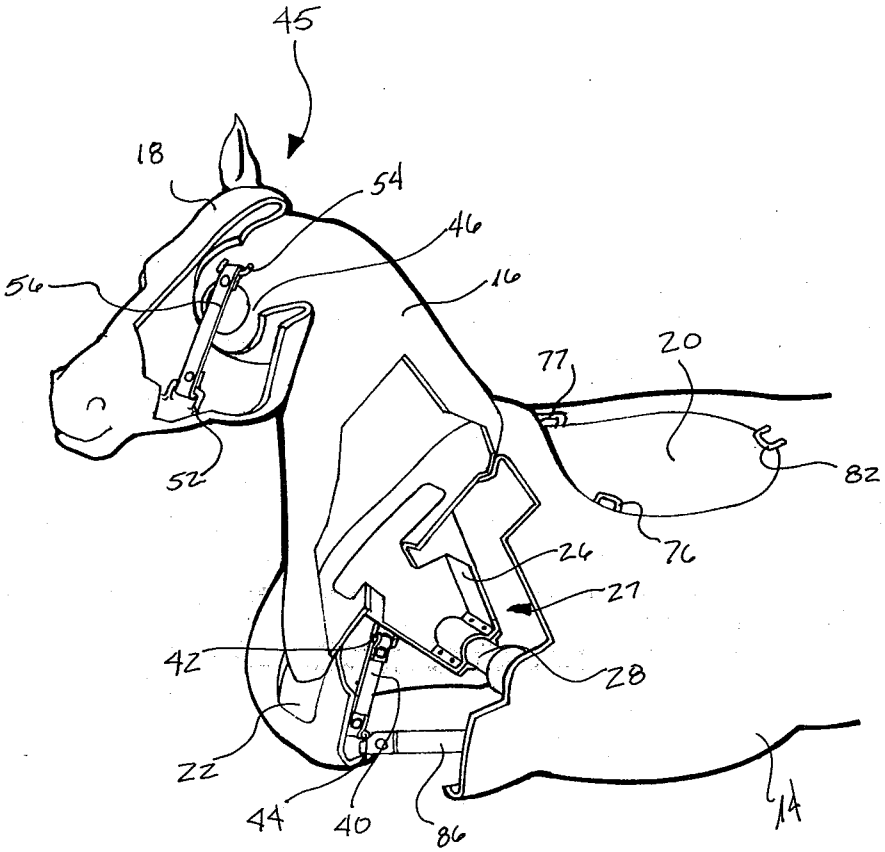
FIG. 6 is a fragmentary partial perspective view partly cut-away to show the interconnections of the head and neck assemblies to each other and to the body member and to show the mechanisms for returning the same to their neutral or at rest positions.

The torso 14 has a channel 22 with an opening 23 therein located at the front end portion thereof as clearly shown in FIGS. 1, 5 and 6 for cooperatively receiving the neck assembly 16 which is mounted for movement therein. A tail member 24 is secured to the rear end portion of the torso 14. The tail member 24 may be an elastic tail or it may be entirely formed from an elasticized and/or plasticized material or a simulated hair material or flocking so as to create a realistic appearance.

Figure 7:
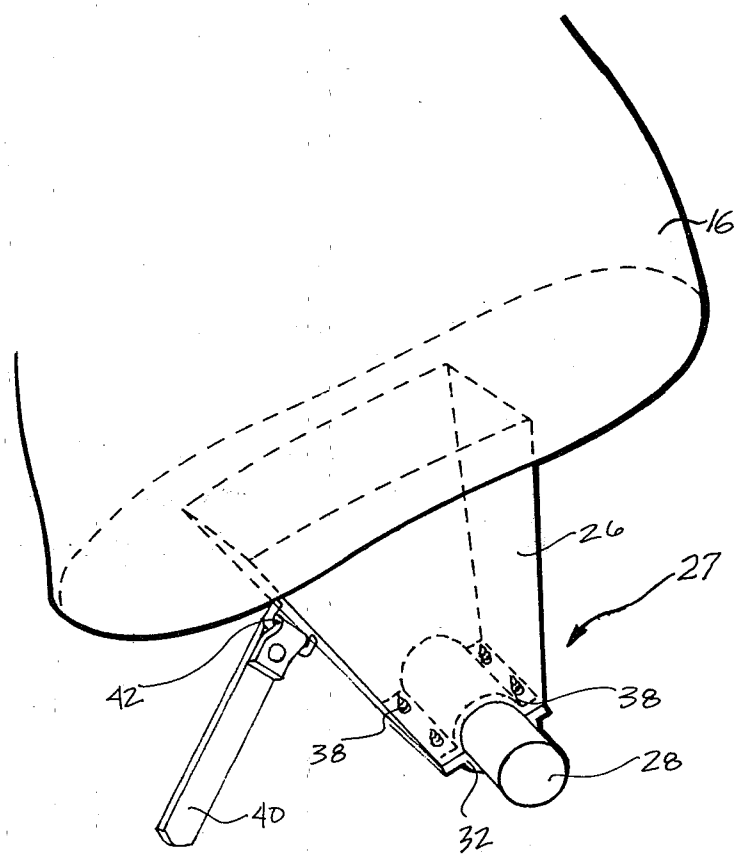
FIG. 7 is a fragmentary perspective view showing the details of the mechanism for connecting the neck assembly to the body member.

The neck assembly 16 includes a downwardly extending flange portion 26 which extends through the opening 23 in the channel 22 in the torso 14, and the flange portion 26 has pivot means 27 associated therewith for pivotally connecting it to a transverse shaft member 28 that extends between opposite side wall portions of the torso 14. In this way the neck assembly 16 is able to be pivoted in a vertical plane about the shaft 28 as shown in FIGS. 5–7. The pivot means 27 includes a semi-circular indentation 30 formed in the lower edge of the flange portion 26, which indentation 30 is dimensioned to engage one side of the shaft member 28 when placed in abutment therewith, and the neck assembly 16 is maintained in this position by means of a bracket member 32 which includes a semi-circular portion for extending around the lower portion of the shaft member 28. The bracket 32 has flange portions 34 and 36 with holes 37 therethrough for receiving threaded members 38 which are used to attach the member 32 to the portion 26 (FIGS. 6 and 7). The length of opening 23 defines the range of possible vertical neck movement.

Figures 2, 3, 4:
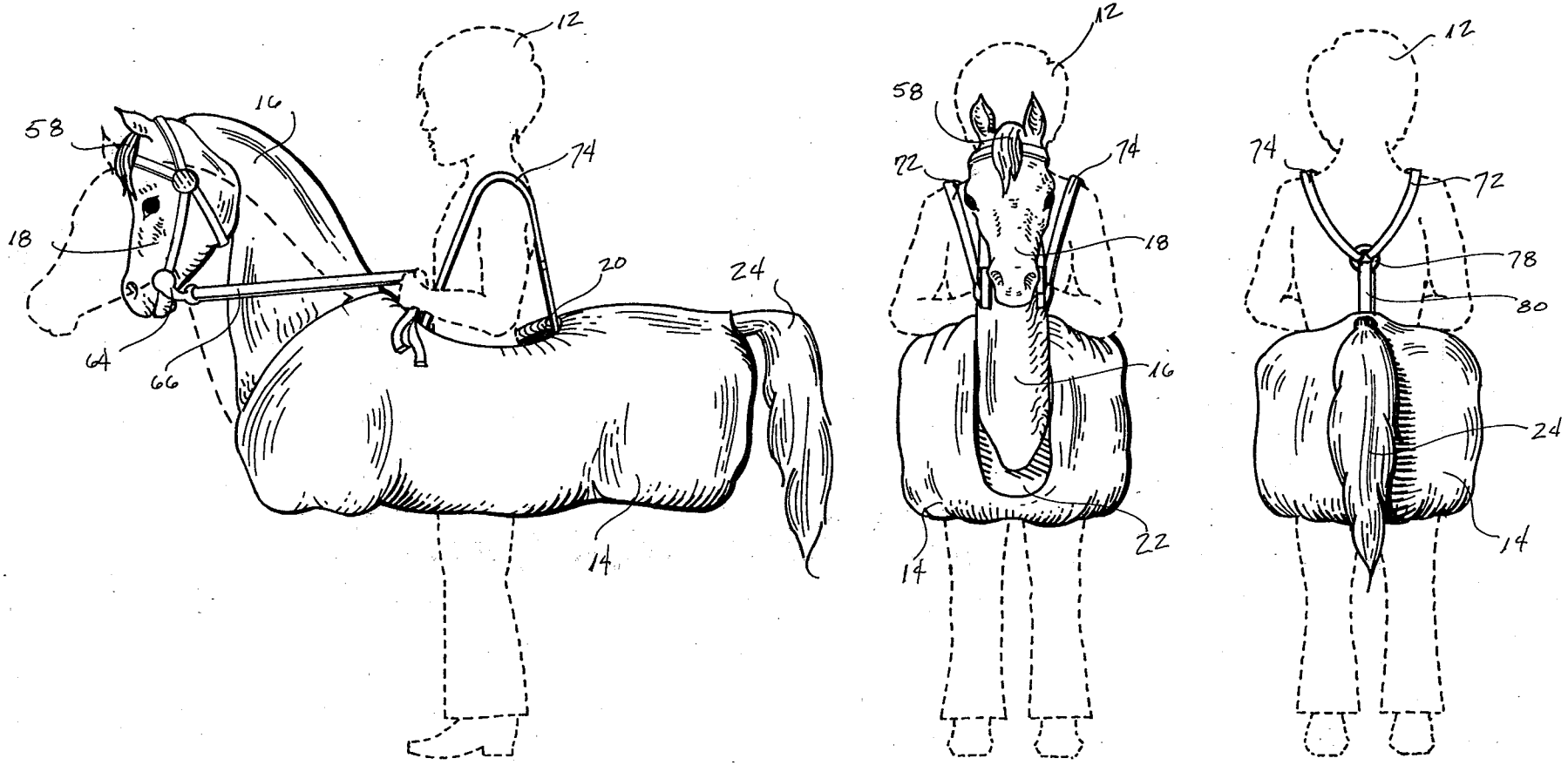
FIG. 2 is a side elevational view of the present toy construction showing the neutral or at rest positions of the movable head and neck assemblies in dotted outline.
FIG. 3 is a front elevational view of the toy of FIG. 1.
FIG. 4 is a rear elevational view of the toy of FIG. 1.

It is important to the present invention that means be provided to urge the neck assembly 16 towards a neutral or at rest position which is the forward and downward position as shown in FIGS. 1 and 2. This is achieved by providing spring means or elastic means such as elastic strap member 40 (FIGS. 5, 8 and 9) which is attached at one end to the downwardly extending flange portion 26 by suitable connecting means such as by U-shaped attaching member 42 and at its opposite end to similar means 44 attached to the torso 14. The elastic member 40 urges the neck assembly 16 towards its predetermined at rest position. This is important in making the neck movement simulate realistic neck movements which occur in a real horse or any other animal during rearing, drinking, and other such movements, and, as will be shown, this at rest neck position makes it possible for the user to control neck movement by means of reins as will be described. It is recognized, however, that there are other suitable means which may likewise be utilized to urge the neck into the same at rest position such as a conventional spring member or other elasticized members.

Figure 9:
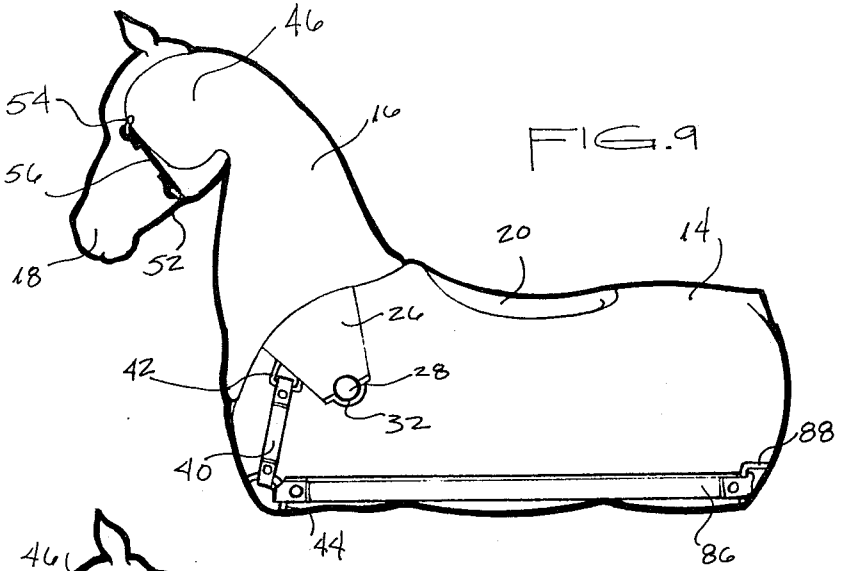
FIG. 9 is a cross-sectional side elevational view of the present toy construction showing the head assembly in a lowered position and the neck assembly in a raised or reined in position.
Figure 8:
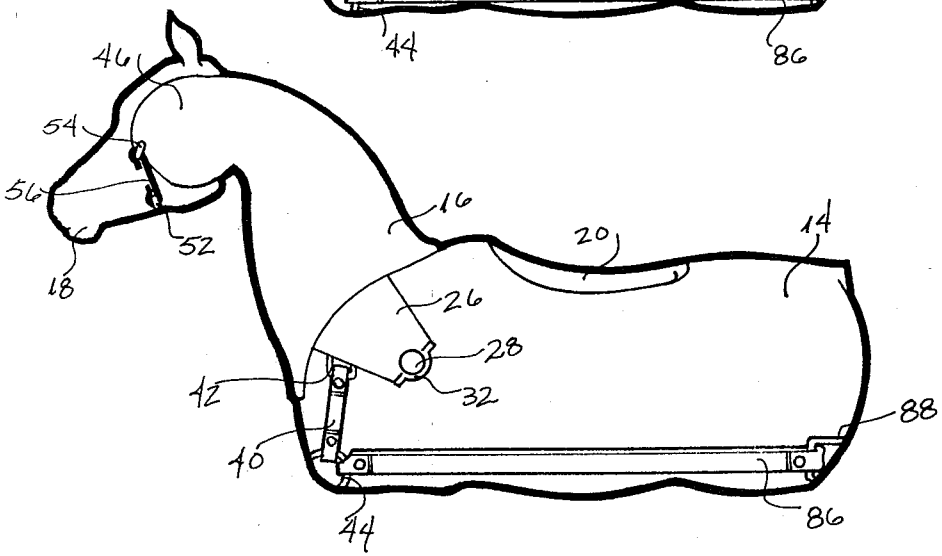
FIG. 8 is a cross-sectional side elevational view of the present toy construction showing the movable head and neck assemblies in their neutral or at rest positions.

The head assembly 18 is pivotally connected to the upper end portion of neck assembly 16 by ball and socket connection means 45 which are constructed to enable the head assembly 18 to move in many different directions thereon to simulate the various possible movements of a horse's or other animal's head relative to the neck assembly 16. The upper end portion of neck assembly 16 includes a ball portion 46 formed thereon for cooperatively engaging a correspondingly shaped socket portion 48 formed within the head assembly 18 as shown in FIGS. 5, 8 and 9. It is preferred that pivot means such as the pivot means 45 be utilized in the connection between the neck and head portions because such means permit head motion in substantially all directions that a horse's head can move on its neck to effectively and realistically simulate the motions of turning and tossing. It is also important to provide means to continuously urge the head assembly 18 to some neutral or at rest position on the neck 16 and this at rest position should be such that the reins will be able to produce the desired head movements. This makes it possible for the person using the present device to always start from the same starting point and always be able to produce the desired head and neck movements by using the reins in their usual manner. This is achieved by providing resilient means such as spring member 50 which has one end secured to the head assembly 18 as by hooking or clipping to an attaching member 52 (FIG. 5) and by attaching the opposite end of the resilient member 50 to the ball portion 46 of neck assembly 16 by a member 54 (FIGS. 6, 8–12). The resilient member 50, like resilient member 40, functions to constantly urge the head assembly 18 towards a predetermined at rest position so that the operator must exert force, as will be hereinafter explained, in opposition to the means 40 and 50 to move the head and neck to simulate the various desired movements. The spring 50 can be substituted for by an elastic strap member 56 such as is shown in FIGS. 6 and 8–12. The neck and head assemblies 16 and 18 as well as the body 14 can be relatively easily molded of plastic or other relatively light-weight material or they can be fabricated and formed of parts assembled and connected using well known techniques. Additionally, the various parts of the subject device 10 can be decorated and colored to produce as much realism as desired. For example, the head assembly 18 can include a forelock 58 formed from an elasticized and/or plasticized material or it can be molded as part of the head.

The means for controlling and imparting movement to the neck and head portions 16 and 18 includes a bridle assembly 60 with suitable straps and headstall 62, and a bit member 64 which is connected to reins 66 attached thereto as shown for example in FIG. 1. The user by manipulating the reins 66 can impart movement to the head and neck in opposition to the forces exerted by the resilient members 40 and 50. Although the reins 66 may be permanently affixed to or attached to the head assembly 18, it is preferred that the bridle assembly 60 including the headstall 62, the bit member 64, the reins 66, and other appendages associated therewith be utilized to increase realism both as to appearance and as to operation. In this regard, it should be noted that the front portion of the head assembly 18 may likewise include a groove or slot 68 as shown in FIG. 5 for cooperatively receiving the bit member 64 whenever the bridle assembly 60 is placed in proper position on the head assembly 18. The entire bridle assembly 60 including the reins 66 can be fabricated from known materials such as leather, canvas, plastic or other natural and/or synthetic material.

The exertion of a pulling force on the reins 66 controls the movement of the head and neck assemblies by pivotally rotating the head assembly 18 on the neck 16 and the neck assembly on the body 14. The relative resilience of the members 40 and 50 will also have a bearing on how much head movement will be produced relative to the amount of neck movement. If the resilient member 50 (or 56) is weaker than the member 40, the head assembly 18 will move first and vice versa. Once some head and neck movement is achieved, the operator need only let up on the reins 66 for the neck and head assemblies to return to their at rest positions.

Figure 10:
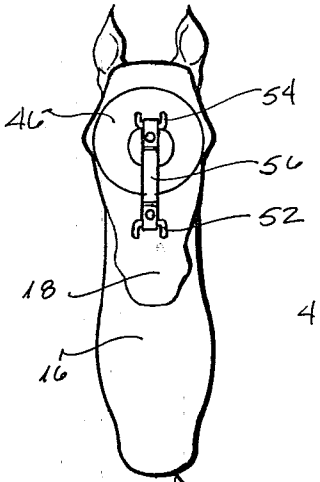
FIG. 10 is a front elevational view of the head and neck assemblies showing the articulated head assembly in an upright neutral position.
Figure 11:
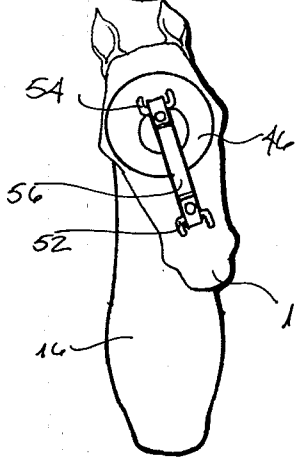
FIG. 11 is a view similar to FIG. 10 showing the head assembly rotated on the neck assembly to a position angularly displaced in one direction.
Figure 12:
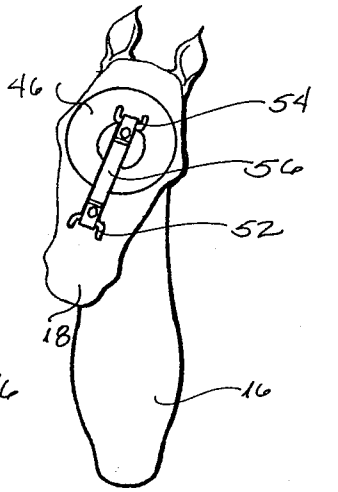
FIG. 12 is another view similar to FIG. 10 showing the head assembly rotated in a different position on the neck assembly.

FIGS. 8–12 detail several different conditions of possible relative movement between the neck and head assemblies 16 and 18 and the corresponding tensioning of their respective resilient members 40 and 56. FIG. 8 depicts the head and neck assemblies and their respective resilient members in their at rest positions, and FIG. 9 shows movement of the head and neck wherein the head assembly 18 is rotated inwardly toward the neck to a lowered position while the neck assembly 16 is simultaneously drawn upwardly to a raised position. Any movements of the head and neck assemblies work in opposition to the resilient members 40 and 56 so that when the pulling force exerted on the reins 66 is released, the assemblies will return to their respective at rest positions. FIGS. 10–12 show three different positions of the head assembly 18 relative to the neck assembly 16 to simulate head turning or tossing movements. These movements likewise work in opposition to the resilient member 56 such that when the pulling force is released, the head assembly 18 will return to its centered at rest position.

A shoulder harness assembly 70 (FIG. 5) is attached to the body 14 adjacent to the central opening 20 as explained for holding and supporting the device at the proper position. The shoulder harness assembly 70 is shown for illustrative purposes as being substantially Y-shaped (FIGS. 4 and 5) including strap members 72 and 74 which are attached to respective attachment members 76 and 77 located on the body 14. The straps 72 and 74 extend over respective shoulders of the user and are connected or attached to a connection member 78 (FIG. 5) which is connected to a back strap 80 which in turn is attached to a member 82 (FIG. 6) adjacent the rear of the opening 20. Strap length adjustment means such as buckles 84 are located in each of the straps 72 and 74 for allowing the user to adjust the straps to fit the person wearing the device.

A leg strap member 86 extends lengthwise in the cavity of the body 14 and is fastened at both ends thereof to members 44 and 88 located at the front and rear of the body 14 as shown in FIGS. 5, 8 and 9. The leg strap 86 is centrally positioned laterally so that it will extend between the legs of a child or other user. The leg strap member 86 is important to the invention because it effectively stablizes the device 10 and makes it easier to control. For example, the pressure of the user's leg exerted on the strap 86 helps to keep the device in alignment front-to-rear on the wearer and increases the ability of the wearer to control the device. To this end the strap 86 needs to be relatively taut so that turning movements will be transmitted to the body 14. Furthermore, the leg strap member 86 tends to some extent to counteract body movements of the device when the reins are pulled on to effect head and neck movements. This means that when the reins 66 are pulled on to impart movement to the neck and head assemblies 16 and 18, the body 14 will remain in a relatively stable horizontal position on the user without bobbing up and down. The leg strap 86 also acts as a dampening mechanism to keep the body 14 from swaying back and forth like a pendulum. As the user turns in any direction, the body 14 will react as the motion is transmitted through the shoulder harness assembly 70. In order to prevent this swaying motion, the leg strap member 86 stretches next to the user's leg and absorbs the energy generated by the turning motion and allows a more balanced movement by the user coupled with a smoother action similar to that of a real horse or other animal. Some dampening also occurs in the vertical direction as when the wearer is running with the device on. Care should be taken in selecting the material for the strap 86 to ensure that it does not cause friction burns, chaffing, and other irriations and discomforts to the person wearing and using the present device, and the strap may be substituted for by a suitable rigid member although a strap is usually preferred.

The body, neck and head portions of the present device are preferably constructed of a durable, lightweight molded material such as plastic, fiberglass, or other synthetic material able to withstand moderate impact and normal usage. It is also anticipated that the present device can be made and designed so as to proportionally match the confirmation of a wide variety of animals and other characters including those mentioned above. There are many possibilities for design and material usage that can be used and it is not intented to limit these in any substantial manner. In addition, the front portion of the torso 14 may be greater in weight as compared to the rear portion thereof.

Thus there has been shown and described a novel toy construction including means for simulating realistic animal movements, which construction fulfills all of the objects and advantages sought therefor. Many changes, modifications, variations and other uses and applications of the present construction will, however, become apparent to those skilled in the art after considering this specification and the accompanying drawings. All such changes, modifications, variations, and other uses and applications which do not depart from the spirit and scope of the invention are deemed to be covered by the invention which is limited only by the claims which follow.

What is claimed is:

1. A toy to be worn by a person for play and ornamentation comprising an elongated substantially hollow body member open at the bottom and having a central opening therethrough that is large enough to receive the body of the person wearing the toy, a second body opening located adjacent to one end of the body member, a support member attached to the body member and extending across the inside of said body member adjacent to said second opening, an elongated assembly having a first end portion positioned so as to extend into said second body opening and having means thereon attachable to the support member in a manner to permit some limited movement of the elongated assembly relative to said body member, said elongated assembly having a rounded opposite end portion, a second assembly having a socket formed therein for cooperative engagement with the rounded end portion of said elongated assembly, first yieldable means connected between the body member and the elongated assembly biasing said elongated assembly towards a predetermined at rest position relative to the body member, second yieldable means connected between the elongated assembly and the second assembly biasing said second assembly towards a predetermined at rest position relative to said elongated assembly, harness means attached to said body member adjacent to said central opening therein for supporting said toy from the shoulders of the person wearing the same, a stabilizing strap having opposite end portions connected respectively to said body member adjacent opposite ends thereof for extending across the inside of said hollow body member between the legs of the person wearing the toy, and strap means connected to said second assembly for operation by the person wearing the toy to control the movements and positions of said elongated assembly and said second assembly.

2. The toy defined in claim 1 wherein said elongated assembly is movable in a substantially vertical plane within said second body opening between a predetermined at rest position and an elevated position angularly related thereto.

3. The toy defined in claim 1 wherein the characteristics of the second body opening defines the range of movement of said elongated assembly therein.

4. The toy defined in claim 1 wherein said second assembly is movable in substantially all directions on the rounded end portion of said elongated assembly between a predetermined at rest position and a position angularly related thereto.

5. The toy defined in claim 1 wherein said harness means includes a substantially Y-shaped harness assembly having a pair of flexible shoulder straps attached at respective ends to the body member adjacent to the central opening therein, and a back strap connected to the shoulder straps and to the body member.

6. The toy defined in claim 5 wherein said pair of flexible shoulder straps include means for adjusting the length thereof.

7. The toy defined in claim 1 wherein said toy is fashioned to have the appearance of a horse.

8. The toy defined in claim 1 wherein said strap means connected to said second assembly includes a bridle assembly having control means attached thereto.

9. The toy defined in claim 1 wherein the front portion of said toy is heavier than the rear portion thereof.

10. The toy defined in claim 1 wherein said toy is constructed of a plastic material.

11. A toy device fashioned to simulate the appearance of an animal comprising a relatively lightweight, hollow shell having the shape and appearance of the body of an animal, said shell having a substantially unobstructed space therewithin and an opening positioned therein to receive the torso of a person wearing the device, a second opening formed in the shell adjacent to one end thereof, a support member attached to the shell and extending across the space therein adjacent to said second opening, a neck assembly having one end portion extending into said second opening and an opposite end portion, said neck assembly having means connecting the neck assembly to said support member for pivotal movement relative thereto and relative to the shell, a head assembly including means pivotally connecting said head assembly to the opposite end portion of said neck assembly for movement relative thereto, first resilient means connected between said shell and said neck assembly urging said neck assembly towards a predetermined at rest position relative to said shell, second resilient means connected between said neck assembly and said head assembly urging said head assembly towards a predetermined at rest position relative to said neck assembly, manually operable actuating means for controlling the movements of the head and neck assemblies, means for supporting the device on the shoulders of a user including a harness assembly attached to the shell adjacent to the opening for the torso of the person wearing the device, and a leg strap connected to opposite ends of the shell and extending lengthwise across the space therewithin, said leg strap being positioned to extend between the legs of the person wearing the device.

12. The toy device defined in claim 11 wherein said means for supporting said device on the shoulders of a user includes strap means with adjustment means for adjusting the length thereof.

13. The toy device defined in claim 11 wherein said device is fashioned to simulate the appearance of a horse.

14. The toy device defined in claim 13 wherein said manually operable actuating means includes reins attachable to said head assembly.

15. A toy horse adaptable to realistically simulate the configuration of a wide variety of breeds comprising a substantially hollow body member open at the bottom and having a relatively unobstructed space formed therewithin, a first body opening formed in the upper portion thereof at a location substantially where a saddle would be positioned, said first body opening being of sufficient size to receive the torso of a person positioned therein, a second body opening located adjacent to one end portion of said body member, a shaft member attached to said body member and extending across the space therein adjacent to the second body opening, a neck assembly having first and second end portions, said first end portion extending into said second body opening and having means thereon for pivotally connecting said neck assembly to said shaft member for movement relative to the body member between a predetermined at rest position and a position angularly related thereto, a first yieldable member connected between said body member and said neck assembly for returning said neck assembly to its predetermined at rest position relative to the body member, a head assembly cooperatively engageable with the second end portion of said neck assembly including means for moving said head assembly in many different directions on said neck assembly, a second yieldable member connected between said neck assembly and said head assembly for returning said head assembly to a predetermined at rest position relative to said neck assembly, a bridle assembly attachable to said head assembly having control means attached thereto for actuating and controlling the movements of said head and neck assemblies, a shoulder harness assembly attachable to said body member adjacent to said first body opening for supporting the device on the shoulders of a user, and a leg strap member centrally positioned below the first body opening and attachable at both end portions thereof to said body member for extending between the legs of a user when positioned therein.

16. The toy horse defined in claim 15 wherein said means for moving said head assembly in many different directions on said neck assembly includes ball and socket means wherein the second end portion of said neck assembly includes a rounded end portion formed thereon for cooperatively engaging a correspondingly shaped socket portion formed within said head assembly.

17. The toy horse defined in claim 15 wherein at least one of said first and second resilient members includes an elastic strap member.

18. The toy horse defined in claim 15 wherein at least one of said first and second resilient members includes a spring member.

19. A horse-like toy to be worn by a person for play comprising a substantially hollow, lightwight body member having a first opening positioned on the upper portion thereof and having a relatively unobstructed space formed therewithin, said first opening being elongated from front to rear so as to receive and accommodate persons of varying stature when positioned therein, a second opening formed in one end portion of said body member, a support member attached to said body member and extending across the space formed therein adjacent to said second opening, a neck assembly having one end portion extending into said second opening and having means thereon for attaching to said support member in a manner to permit movement of said neck assembly relative to said body member in a substantially vertical plane between a predetermined at rest position and an elevated position angularly related thereto, said neck assembly having a rounded opposite end portion, a head assembly having a socket portion formed therein for cooperative engagement with the rounded end portion of said neck assembly, said head assembly pivotally movable on the rounded end portion of said neck assembly in substantially all directions thereon between a predetermined at rest position and a position angularly related thereto, first resilient means connected between said body member and said neck assembly urging said neck assembly towards its predetermined at rest position relative to said body member, second resilient means connected between said neck assembly and said head assembly urging said head assembly towards its predetermined at rest position relative to said neck assembly, reins attachable to said head assembly for controlling the movements and positions of said head and neck assemblies, a substantially Y-shaped shoulder harness assembly attachable to said body member near the front and rear portions of said first opening for supporting said toy at the proper position on a person wearing the same, said shoulder harness assembly including a pair of flexible shoulder strap members having means thereon for adjusting the length thereof, and a stabilizing leg strap having opposite end portions attachable to said body member adjacent opposite end portions thereof, said leg strap being positioned lengthwise below said first opening to extend between the legs of a person when positioned therein.

20. In a toy to be worn by a person for play and ornamentation and including a substantially hollow body member open at the bottom and having a central opening therethrough that is large enough to receive the body of the person wearing the toy, the improvement comprising a stabilizing strap member extending lengthwise across the inside of the body member in spaced relationship below the central opening for extending between the legs of a person wearing the toy, said strap having its opposite end portions connected respectively to said body member adjacent opposite ends thereof and being relatively tightly drawn so as to stabilize the position of the body member on the person wearing the toy and to facilitate control to coordinate movements of the body member to movements of said person wearing the toy.

* * * * *